US008479334B1

(12) United States Patent
Leach

(10) Patent No.: US 8,479,334 B1
(45) Date of Patent: Jul. 9, 2013

(54) PILLOW FOR SUPPORTING A BABY AT PLAY

(76) Inventor: Jamie S. Leach, Ada, OK (US)

( * ) Notice: Subject to any disclaimer, the term of this patent is extended or adjusted under 35 U.S.C. 154(b) by 1111 days.

(21) Appl. No.: 12/199,548

(22) Filed: Aug. 27, 2008

Related U.S. Application Data

(63) Continuation-in-part of application No. 11/849,292, filed on Sep. 2, 2007, now abandoned.

(51) Int. Cl.
*A61G 9/00* (2006.01)

(52) U.S. Cl.
USPC ..... 5/655; 5/652; 5/655.3; 5/655.4; 5/655.5

(58) Field of Classification Search
USPC ..... 5/655, 652, 655.3, 655.4, 655.5
See application file for complete search history.

(56) References Cited

U.S. PATENT DOCUMENTS

| | | | | |
|---|---|---|---|---|
| 909,453 | A | 1/1909 | Pullman | |
| 2,502,486 | A | 4/1950 | Savrin | |
| 2,626,407 | A | 1/1953 | Kurry | |
| 3,493,228 | A * | 2/1970 | Hicks et al. | 472/134 |
| 3,848,281 | A | 11/1974 | Mathews | |
| 3,902,456 | A | 9/1975 | David | |
| 4,709,430 | A | 12/1987 | Nicoll | |
| 4,712,258 | A | 12/1987 | Eves | |
| 4,834,459 | A | 5/1989 | Leach | |
| 4,861,109 | A | 8/1989 | Leach | |
| D309,018 | S | 7/1990 | Leach | |
| 4,980,937 | A | 1/1991 | Mason et al. | |
| 5,035,013 | A | 7/1991 | Bloom | |
| 5,103,514 | A | 4/1992 | Leach | |
| 5,210,891 | A | 5/1993 | Avital et al. | |
| 5,325,818 | A | 7/1994 | Leach | |
| D366,368 | S | 1/1996 | McCarthy | |
| 5,546,620 | A | 8/1996 | Matthews | |
| 5,581,833 | A | 12/1996 | Zenoff | |
| 5,692,257 | A | 12/1997 | Albertieri | |
| 5,813,066 | A | 9/1998 | Gebhard et al. | |
| 5,839,138 | A | 11/1998 | Weidman et al. | |
| 5,930,854 | A | 8/1999 | O'Neill et al. | |
| 6,038,720 | A | 3/2000 | Matthews et al. | |
| 6,079,067 | A | 6/2000 | Becker et al. | |
| 6,343,727 | B1 | 2/2002 | Leach | |
| 6,370,715 | B1 | 4/2002 | Morton | |
| 6,427,251 | B1 | 8/2002 | Leach | |
| 6,499,164 | B1 | 12/2002 | Leach | |

(Continued)

OTHER PUBLICATIONS

The "Tuckie Duckie" product shown in the webpage (Exhibit A) from http://www.leachco.com published by Leachco, Inc. (Ada, OK, USA) on May 23, 2009, was in public use and/or on sale at least since about Jun. 2005.

(Continued)

*Primary Examiner* — William Kelleher
(74) *Attorney, Agent, or Firm* — Mary M. Lee

(57) ABSTRACT

A pillow for supporting a baby at play. The pillow comprises a compressible, shape-sustaining, endless bolster having a center opening sized to receive the baby in a sitting position. Preferably, the bolster is toroidal in shape. The pillow includes a removable, washable cover with a center panel that spans the bottom of the center opening forming a seating area for the baby. The bottom of the cover has an elastic border that it grips the bottom of the bolster. In this way, downward tension on the center panel of the cover pulls the bolster portion of the cover inwardly, restraining the pillow around the baby.

25 Claims, 7 Drawing Sheets

U.S. PATENT DOCUMENTS

| | | | | |
|---|---|---|---|---|
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,763,539 | B1 * | 7/2004 | Bartley et al. | 5/655 |
| 6,799,339 | B2 | 10/2004 | Stewart | |
| 7,000,766 | B2 | 2/2006 | Matthews Brown et al. | |
| 7,010,821 | B1 | 3/2006 | Leach | |
| 7,114,206 | B2 | 10/2006 | Leach | |
| 7,146,663 | B2 | 12/2006 | Brown et al. | |
| 7,353,552 | B2 | 4/2008 | Leach | |
| 7,500,278 | B2 | 3/2009 | Leach | |
| 7,513,001 | B1 | 4/2009 | Leach | |
| 2005/0210591 | A1 * | 9/2005 | Mead et al. | 5/639 |
| 2005/0278864 | A1 | 12/2005 | Leach | |
| 2006/0236461 | A1 * | 10/2006 | Ryan | 5/655 |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0204402 | A1 * | 9/2007 | Harris et al. | 5/655 |
| 2007/0277321 | A1 | 12/2007 | Leach | |

OTHER PUBLICATIONS

The "Bath 'N Bumper" product shown in the webpage (Exhibit B) from http://www.leachco.com published by Leachco, Inc. (Ada, OK, USA) on Jan. 28, 2008,was in public use and/or on sale at least since about Aug. 1999.

The "Wee Sleep" product shown in the webpage (Exhibit C) from http://www.leachco.com published by Leachco, Inc. (Ada, OK, USA) on May 17, 2007, was in public use and/or on sale at least since about Aug. 2000.

The "Baby Go Round" product shown in the webpage (Exhibit D) from http://www.leachco.com published by Leachco, Inc. (Ada, OK, USA) on May 26, 2009, was in public use and/or on sale at least since about Aug. 1991.

* cited by examiner

PILLOW FOR SUPPORTING A BABY AT PLAY

CROSS-REFERENCE TO RELATED APPLICATIONS

This application is a continuation in part of application Ser. No. 11/849,292 entitled "Pillow for Supporting a Baby at Play," filed Sep. 2, 2007, and the contents of the prior application are incorporated herein by reference.

FIELD OF THE INVENTION

The present invention relates generally to pillows and particularly to support pillows for infants and toddlers.

BACKGROUND OF THE INVENTION

An infant's mental and physical development is stimulated by play, including the use of toys. Babies and toddlers, especially those who are not yet walking steadily, may benefit by having some support surrounding them to help them maintain their balance while entertaining themselves. Various pillows are available for supporting infants and toddlers during different activities. However, the remains a need for a pillow that will provide good support for a baby in a seated position while still allowing some freedom of movement.

DETAILED DESCRIPTION OF THE PREFERRED EMBODIMENTS

The play pillow of this invention allows the seated baby room to lean to and fro and move his legs and arms and yet still provides firm support surrounding the child. The compressible bolster provides support to help the baby remain upright; the baby can lean back on it or steady himself by using the bolster as a grab bar. The bolster is enclosed in a removable cover with a center panel that forms a closed well in the center of the pillow on which the child sits. A retractable border on the bottom of the cover grips the bottom of the bolster. This cover configuration restrains the pillow firmly in an upright position; downward tension on the seat panel pulls the bolster upwardly and inwardly. These and other features and advantages will be apparent from the following description and the attached drawings.

Figure 1:
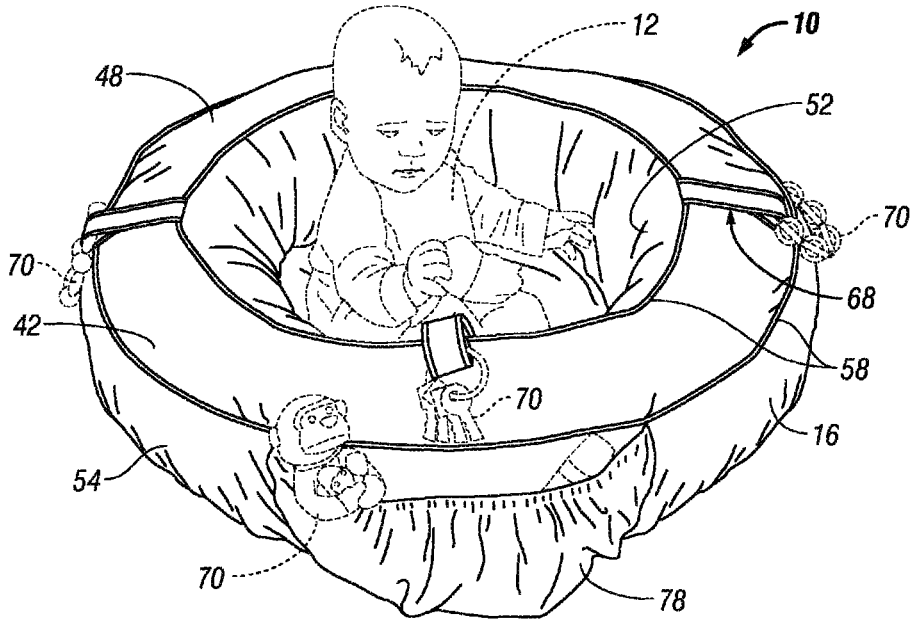
FIG. 1 is a perspective view of a play pillow made in accordance with the present invention. An infant, shown in broken lines, is seated in the center.
Figure 2:
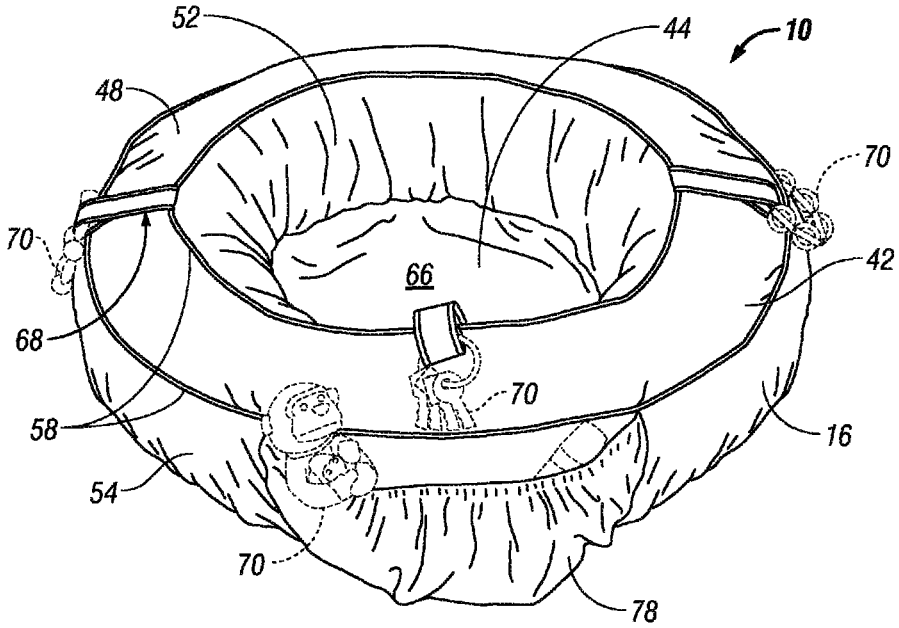
FIG. 2 is a perspective view of the play pillow, without the infant, showing the open play area in the center.

Turning now to the drawings in general and to FIGS. 1-2 in particular, there is shown therein a pillow made in accordance with a preferred embodiment of the present invention and designated generally by the reference numeral 10. The pillow 10 is designed to support a baby 12, shown in broken lines in FIG. 1, while the baby plays inside. As used herein, "baby" includes an infant, a toddler, and a small child.

Referring also to FIGS. 3-6, the pillow 10 comprises a bolster 14 and a removable cover 16. As best seen in FIGS. 3-6, the bolster 14 is compressible and shape-sustaining. That is, the bolster 14 is formed of compressible, resilient material so that it provides good cushioning and yet returns to its original shape or resting position after being compressed or deformed. As used herein, "resting position" refers to the position and shape the bolster 12 naturally assumes when no tension or pressure is exerted on any part of it.

The bolster 14 is endless and has a top surface 20, a bottom surface 22, an inner periphery 24 and an outer periphery 26. As the drawings herein suggest, the top 20 and the bottom 22 of the bolster 14 preferably are identical so that the bolster can be flipped from side to side. That is, the "top" and "bottom" of the bolster are in fact interchangeable. Thus, as used herein, "top" refers to the side of the bolster 14 that is uppermost in the assembled pillow 10. Likewise, the "bottom" of the bolster 14 is the side that forms the bottom of the assembled pillow 10.

Figure 3:
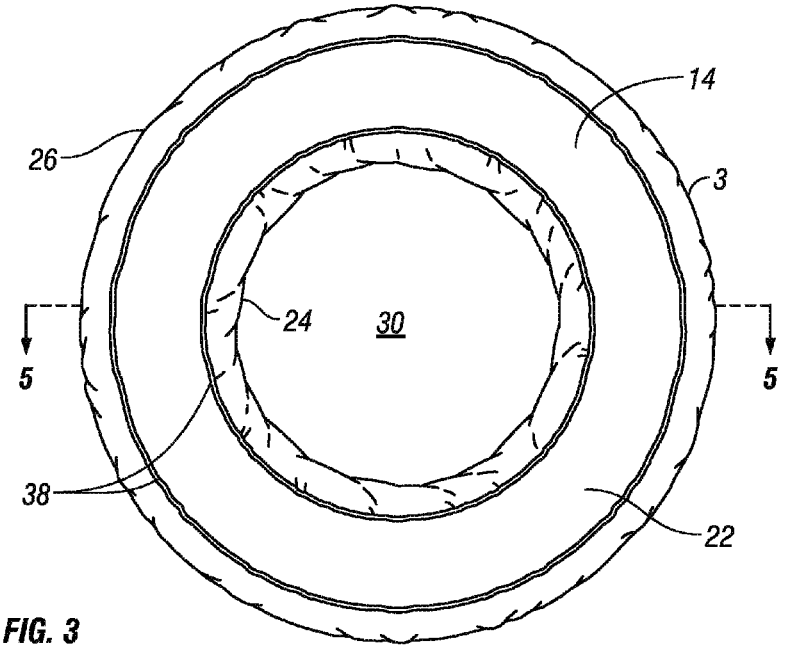
FIG. 3 is bottom plan view of the bolster of the pillow.
Figure 5:
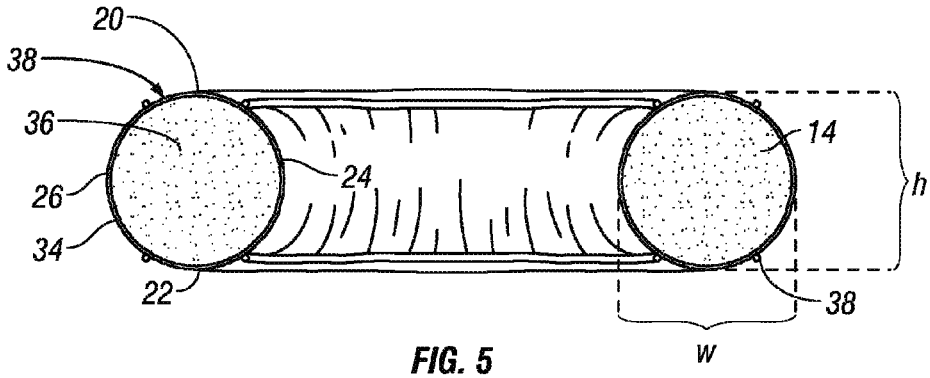
FIG. 5 is a sectional view of the bolster taken along line 5-5 of FIG. 3.

The height of the bolster 14, designated at "h" in FIG. 5 is the distance between the top 20 and the bottom 22. The width of the bolster 14, designated at "w" in FIG. 5, is the distance between the inner periphery 24 and the outer periphery 26. The endless shape allows the inner periphery 24 to define a central well or opening 30 (FIG. 3).

While the shape of the pillow 10 may vary, the preferred shape is toroidal so that the inner and outer periphery 24 and 26 both are circular and so that the bolster 14 has a constant transverse cross-section along its entire length. However, the pillow 10 may be oval, square, rectangular, or have another polygonal or irregular shape. Although in the preferred toroidal form, the inner periphery 24 and the outer periphery 26 have the same shape, forming concentric circles, the shape of the central opening 30 may be different from the shape of the outer periphery of the pillow 10. For example, the inside opening 30 could be circular while the outer periphery 26 is square. Similarly, though a bolster 14 with a constant cross-sectional shape is preferred, the height "h" or width "w" of the bolster could vary along its length.

While the dimension of the pillow 10 may vary, the central well or opening 30 preferably is sized to receive the baby 12 in a sitting position as shown in FIG. 1. To accommodate children of different sizes, the diameter of the central opening 30 preferably is between about 8 to about 30 inches, and more preferably is between about 12 and 24 inches, and most preferably is about 16 to 20 inches in diameter.

Where the shape of the bolster 14 is toroidal, a preferred circumference is between about 80 and 110 inches, with about 90 inches being ideal in most instances providing an outside diameter of about 25 to 30 inches. The height "h" and width "w" of the bolster 14 may be the same or different, depending on the desired cross-sectional shape of the bolster. In the illustrated embodiment, the height "h" and the width "w" are between about 5 to about 10 inches, and preferably about 7 inches.

The bolster 14 may be made in various ways, preferably comprising a fabric enclosure 34 with a compressible filler material 36 contained therein. The fabric enclosure 34 may be integrally formed or constructed by sewing several panels together to form the endless ring shape. In the most preferred form, the enclosure 34 is formed of four panels of fabric, two flat annular panels forming the top and bottom surfaces 20 and 22, and two long, slightly gathered panels forming the inner and outer peripheries 24 and 26, stitched together at seams designated collectively at 38.

The fabric of the enclosure 34 may be any suitable fabric, including but not limited to waterproof nylon, flannel, or elastic fabrics, such as spandex or cotton-spandex blends. However, presently a polyester/cotton blend is preferred. A preferred filler material 36 is polyester fiberfill. Other suitable fillers include down feathers, memory foam, and polystyrene pellets. Still further, the bolster 14 could be an inflatable inner tube.

With continuing reference to FIGS. 1-6, the construction of the preferred cover 16 now will be described. The cover 16 may be made of material that is the same as similar to that used for the enclosure 34 of the bolster 14. Of course, it should be soft and flexible, for the baby's comfort, and should be washable. A bright color or colorful pattern is visually stimulating for the child as well as aesthetically pleasing.

The cover 16 comprises a bolster portion 42 and a center panel 44. The bolster portion 42 has the same general shape and size as the bolster 14, though it is slightly larger to easily receive and substantially enclose the bolster 16. Accordingly, the bolster portion 42 has a top 48, a bottom 50, an inner periphery 52, and an outer periphery 54. The inner periphery 52 has a bottom edge 56. As with the enclosure 34 for the bolster 14, the cover 16 may be comprised of an annular panel of fabric forming the top 48, and elongated, gathered panels forming the inner and outer periphery 52 and 54, sewn together at inner and outer upper seams 58.

A retractable border 60 is provided on the bottom 50 of the bolster portion 42 continuous with the outer periphery 54. Preferably, the retractable border takes the form of an elastic edge on the bottom 50 of the bolster portion 42 a distance inwardly from the bottom edge 62 (FIG. 6) of the outer periphery 54. Alternately, the retractable border could be a drawstring, or overlapping folds secured with connectors such as buttons, hook-and-loop fasteners, ties, snaps, hooks, or the like.

Figure 4:
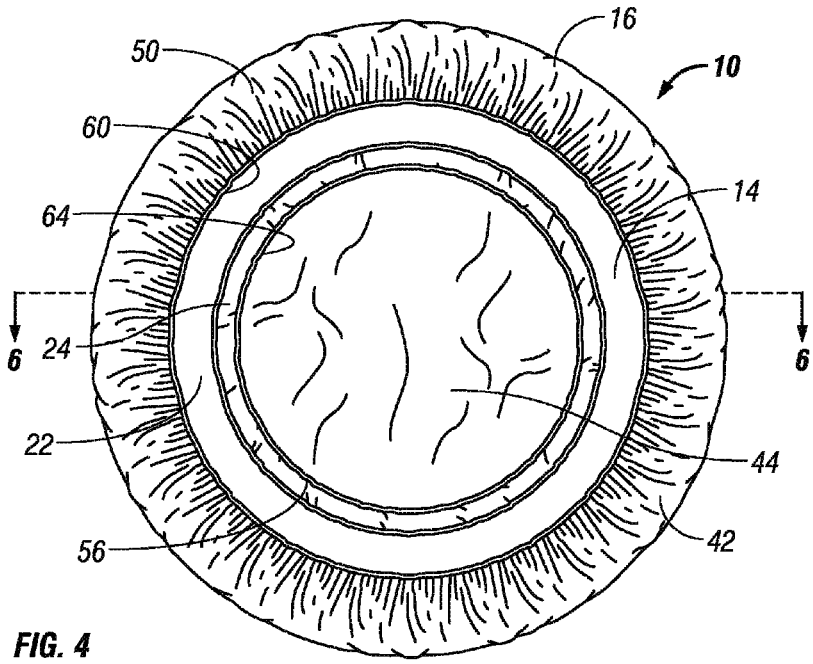
FIG. 4 is a bottom plan view of the pillow, showing the elastic edge on the bottom of the cover.
Figure 6:
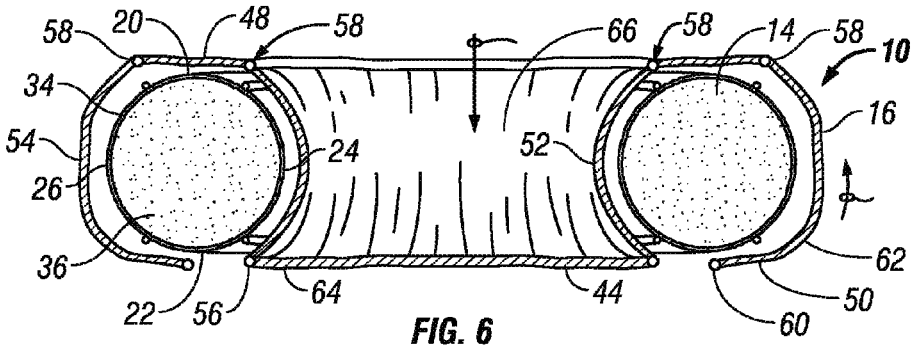
FIG. 6 is a sectional view of the pillow taken along line 6-6 of FIG. 2.

As shown best in FIGS. 4 and 6, the center panel 44 preferably is flat or generally planar and is positioned to span at least a portion of the center opening 30 at about the same level as the bottom 22 of the bolster 14. More preferably, the center panel 44 is shaped and sized to span substantially the entire center opening 30. It has an outer edge 64 fixed to the bottom edge 56 of the inner periphery 52 of the bolster portion 42, forming therewith a closed well designated generally at 66.

Referring still to FIGS. 4 and 6, the space 70 between the retractable border 60 and the outer edge 64 of the center panel 44 forms an annular opening through which the bolster 14 can be inserted and removed from the cover 16. Of course the shape of the opening 70 will vary depending on the shape of the pillow 10.

Now it will be appreciated that, when the bolster 14 is received in the cover 16, the elastic border 60 grips the bottom 22 of the bolster. In this way, downward tension exerted on the center panel 44 causes inward and upward tension on the bolster portion 42 of the cover 16, which in turn restrains the bolster 14 itself. This prevents the bolster 14 from being excessively deformed. As used herein, "downward" denotes a direction running from the top 20 to the bottom 22 of the pillow 10.

Figure 7:
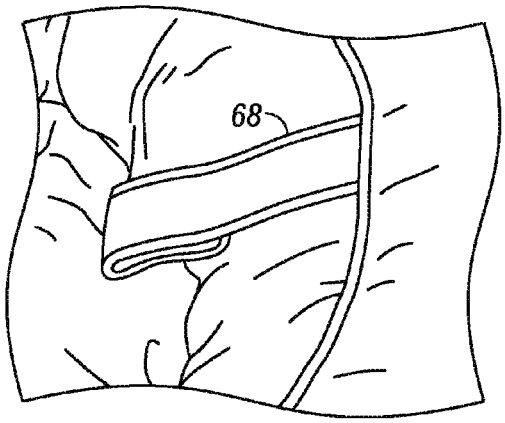
FIG. 7 is an enlarged, fragmented view of the top of the pillow showing a toy attachment loop.
Figure 8:
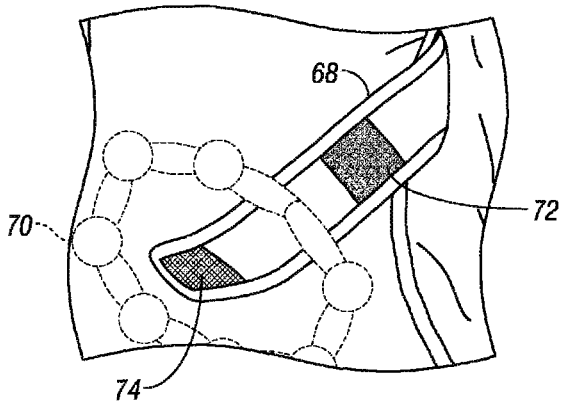
FIG. 8 is enlarged, fragmented view of the top of the pillow showing an open toy attachment loop. A ring-shaped toy is shown in broken lines.
Figure 9:
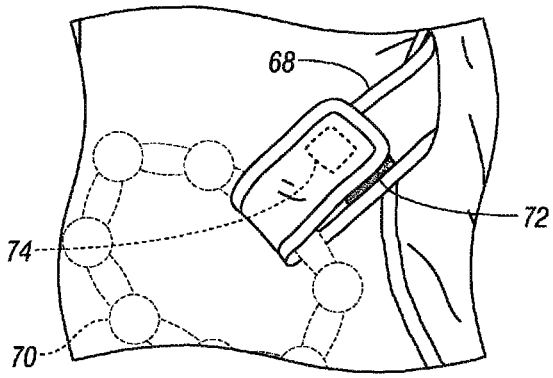
FIG. 9 is enlarged, fragmented view of the top of the pillow showing a closed toy attachment loop holding the ring-shaped toy (broken lines).
Figure 10:
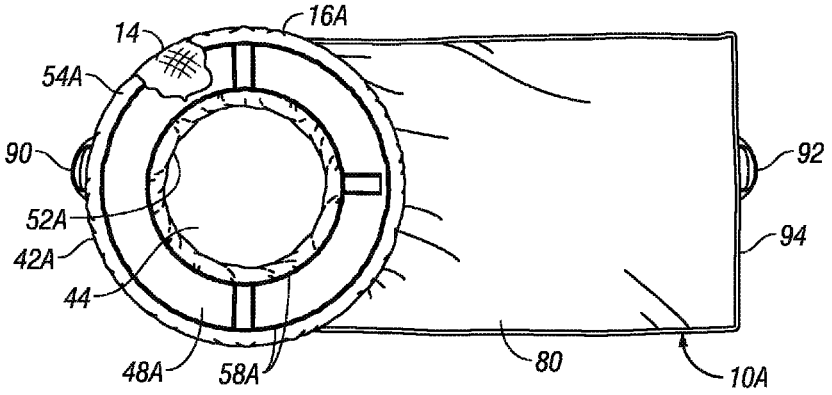
FIG. 10 is a bottom view of a second embodiment of the pillow of the present invention wherein the cover includes an attached blanket or play mat.
Figure 11:
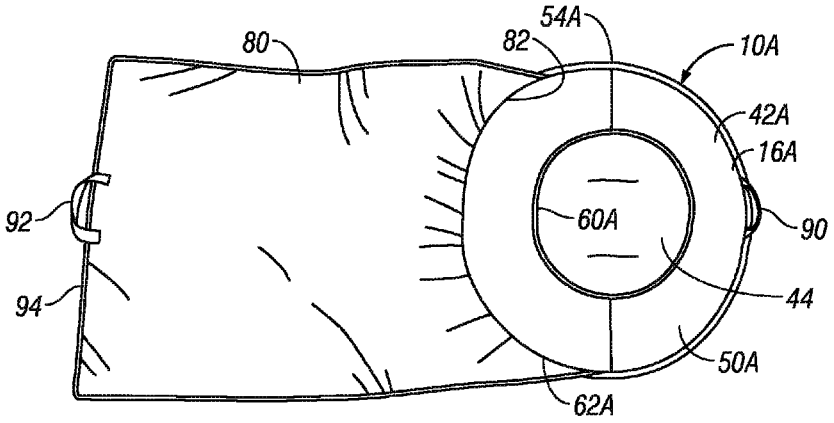
FIG. 11 is a plan view of the embodiment shown in FIG. 10.
Figure 12:
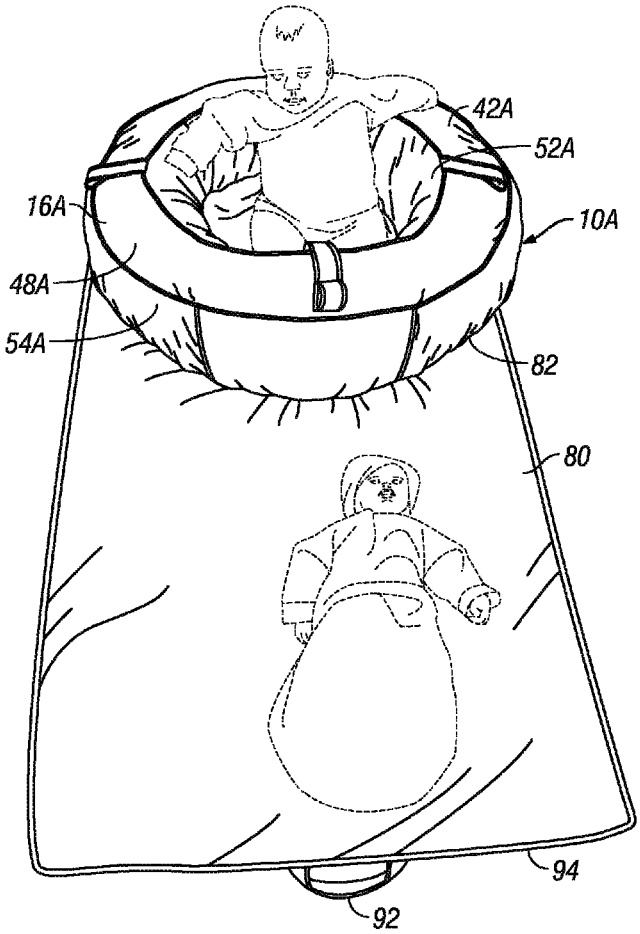
FIG. 12 is a frontal perspective view of the pillow of FIGS. 10 and 11 showing a larger infant seated inside the pillow and a smaller infant lying on the blanket, both infants shown in broken lines.

Returning briefly to FIGS. 1 and 2, it is convenient to provide the pillow 10 with flaps or loops designated generally at 68 for removably attaching toys 70 (shown in broken lines) to the pillow 10. As shown in more detail in FIGS. 7-9, mating hook-and-loop fasteners 72 and 74 are provided for opening and closing the loops 70, though other connectors, such as buttons, ties, snaps, and the like could be used instead. Additionally, one or more pockets 78 may be included on the cover 16 for holding toys, sound devices, cell phones, bottles, sippy cups, and so forth.

Although not illustrated in the drawings, the cover 16 may be reversible. To that ends, toy loops 68 and pockets 78 may be provided on both sides of the cover 16. In the reversible cover, the opposing sides of fabric may be different colors, textures or patterns. In some instances, it may be desirable to make one layer waterproof.

Turning now to FIGS. 10-13 a second embodiment of the inventive pillow will be described. In this embodiment, the pillow designated generally at 10A comprises a bolster 14 as in the previous embodiment. The cover 16A comprises a bolster portion 42A and a center panel 44. The bolster portion 42A is similar to the bolster portion 42 of the first embodiment, except that the bottom 50A may be made from a separate, annular panel of fabric similar to the top 48 in the first embodiment.

The inner and outer peripheries 52A and 54A of the cover 16A may be similarly comprised of elongated, gathered panels, except that the bottom edges of the outer peripheral panels are sewn at the bottom, outer edge 62A (FIG. 11) to the outer edge of the bottom 50A. As in the previous embodiment, the inner edge of the bottom 50A defines a retractable border 60. However, in this embodiment, the border 60 is non-elastic, the pliability of the fabric permitting the border to be retracted enough to insert and remove the bolster 14.

In accordance with this second embodiment, the cover 16A further comprises a mat 80. The mat 80 may take many shapes, but preferably the mat includes an edge 82 defining a curve that conforms to radius of the bottom edge 62A of the outer periphery 54A of the bolster portion 42A of the cover 16A. The curved edge 82 then may be attached to the bolster portion 42A, preferably in some permanent manner as by stitching.

The construction of the mat 80 may vary. However, it most instances, it will be preferable for the mat to comprise an inner padded layer (not shown). This gives the mat 80 some body and is more comfortable for an infant lying or playing on the mat. It will be appreciated that although a generally rectangular mat is shown herein, the shape of the mat may differ widely. In most instances, it will large enough to serve as a play mat, or as changing mat, or both.

Figure 13:
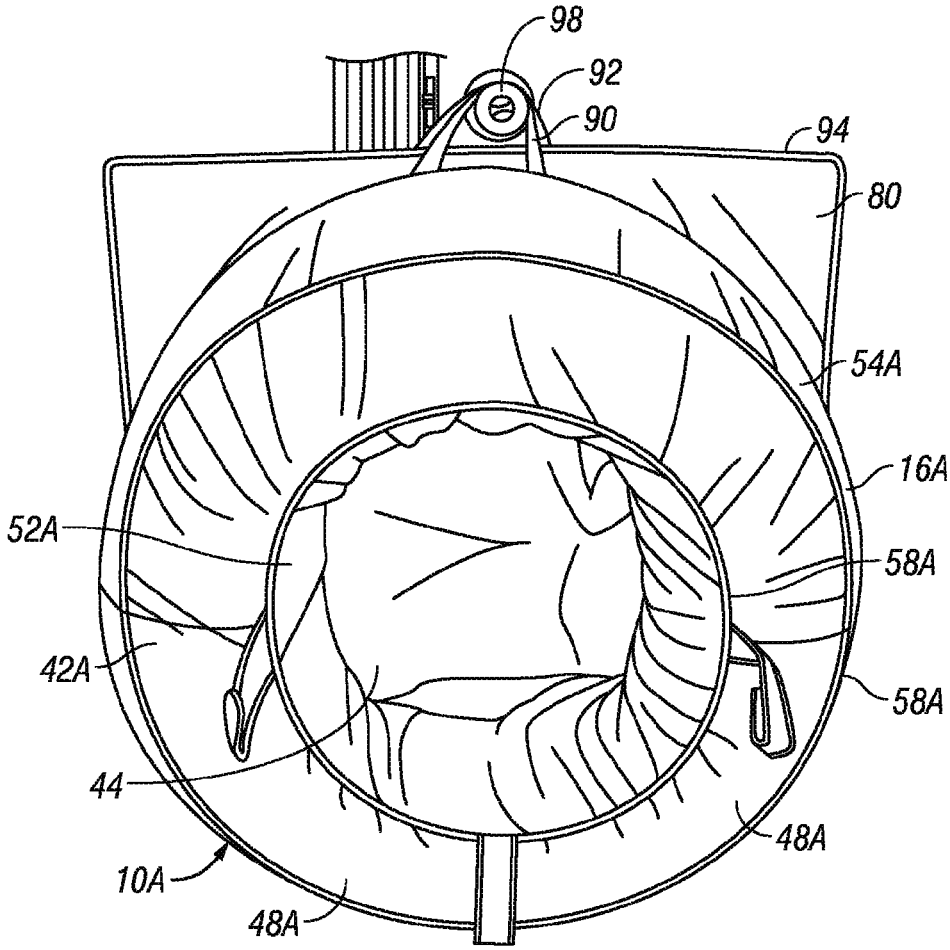
FIG. 13 is a perspective view of the pillow of FIG. 12 shown with the blanket folded back up against the bottom of the pillow in a storage or transport configuration. Handles on opposite ends of the pillow are shown looped over a door knob.

Also shown in FIGS. 10-13 are handles 90 and 92 provided on one side of the bolster cover 16A and on the opposite, free edge 94 of the mat 80. In this way, the pillow 10A can be folded in half, bringing together the handles 90 and 92, providing a convenient transport or storage mode. The folded pillow 10A can be carried or hung in any convenient location, such as a door knob 98, as shown in FIG. 13. Additionally, it should be noted that objects (not shown), such as toys and stuffed animals, can be placed inside the folded pillow.

While the preferred embodiment of the present invention provides an ideal pillow for supporting a baby at play, it is not so limited. The inventive pillow alternately may be used as a bed for a pet, such as a cat or dog. When this is the intended use, it is advantageous to make the cover out of a rough, textured material. It is also often desirable to make the cover reversible with a cooler fabric for summer on one side, and warmer fabric on the other side for winter.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow for supporting a baby at play, the pillow comprising:

a compressible, shape-sustaining, endless bolster having a top and a bottom surface, the height of the bolster being the distance therebetween, and having an inner periphery and an outer periphery, the width of the bolster being the distance therebetween, the inner periphery defining a central opening through the bolster, the opening sized to receive the baby in a sitting position;

a removable cover comprising:

a bolster portion having generally the same shape as the bolster and being sized to substantially enclose the bolster, having a top, a bottom, an inner periphery, the inner periphery having a bottom edge, and an outer periphery, and a retractable border on the bottom continuous with the outer periphery; and a center panel having an outer edge fixed to the bottom edge of the inner periphery of the bolster portion, the center panel shaped to span the central opening in the body at about the same level as the bottom of the bolster forming a closed well;

wherein the space between the retractable border and the outer edge of the center panel forms an opening through which the bolster can be inserted into and removed from the cover;

wherein, when the bolster is received in the cover, the retractable border grips the bottom of the bolster so that downward tension on the center panel of the cover causes inward tension on the bolster portion of the cover restraining the bolster.

2. The pillow of claim 1 wherein the bolster comprises a fabric enclosure and a filler material contained therein.

3. The pillow of claim 1 wherein the pillow is toroidally shaped.

4. The pillow of claim 1 wherein the outer periphery of the bolster defines a circle.

5. The pillow of claim 4 wherein the inner periphery of the bolster defines a circle.

6. The pillow of claim 5 wherein the pillow is toroidally shaped.

7. The pillow of claim 6 wherein the bolster comprises a fabric enclosure and a filler material contained therein.

8. The pillow of claim 7 wherein the pillow further comprises means for removably attaching toys.

9. The pillow of claim 7 wherein the cover has at least one pocket.

10. The pillow of claim 1 wherein the inner periphery of the bolster defines a circle.

11. The pillow of claim 1 wherein the pillow further comprises means for removably attaching toys.

12. The pillow of claim 11 wherein the cover has at least one pocket.

13. The pillow of claim 1 wherein the center panel of the cover is generally planar.

14. The pillow of claim 1 wherein the center panel spans substantially the entire center opening.

15. The pillow of claim 1 wherein the bolster has a constant transverse cross-section along its entire length.

16. The pillow of claim 1 wherein the retractable border comprises an elastic edge.

17. The pillow of claim 1 wherein the removable cover is reversible.

18. The pillow of claim 1 wherein the removable cover further comprises a mat attached to the cover.

19. The pillow of claim 18 wherein the mat is permanently attached.

20. The pillow of claim 18 wherein the mat extends radially from the bolster portion of the cover and has a free edge.

21. The pillow of claim 20 further comprising first and second handles, the first handle on the free edge of the mat and the second handle on bolster portion of the cover opposite the mat.

22. The pillow of claim 1 wherein the retractable border comprises a non-elastic edge.

23. The pillow of claim 18 wherein the mat is generally rectangular.

24. A pillow with an enclosed well, the pillow comprising:

a compressible, shape-sustaining, endless bolster having a top and a bottom surface, the height of the bolster being the distance therebetween, and having an inner periphery and an outer periphery, the width of the bolster being the distance therebetween, the inner periphery defining a central opening through the bolster;

a removable cover comprising:

a bolster portion having generally the same shape as the bolster and being sized to substantially enclose the bolster, having a top, a bottom, an inner periphery, the inner periphery having a bottom edge, and an outer periphery, and a retractable border on the bottom continuous with the outer periphery; and a center panel having an outer edge fixed to the bottom edge of the inner periphery of the bolster portion, the center panel shaped to span the central opening in the body at about the same level as the bottom of the bolster forming a closed well;

wherein the space between the retractable border and the outer edge of the center panel forms an opening through which the bolster can be inserted into and removed from the cover;

wherein, when the bolster is received in the cover, the retractable border grips the bottom of the bolster so that downward tension on the center panel of the cover causes inward tension on the bolster portion of the cover restraining the bolster.

25. The pillow of claim 24 wherein the closed well is sized to receive a human child, a cat, or a dog.

* * * * *